US010151267B2

(12) United States Patent
Anetsberger et al.

(10) Patent No.: US 10,151,267 B2
(45) Date of Patent: Dec. 11, 2018

(54) METHOD AND DEVICE FOR OPERATING A PRESSURE RESERVOIR, IN PARTICULAR FOR COMMON RAIL INJECTION SYSTEMS IN AUTOMOBILE ENGINEERING

(71) Applicant: Continental Automotive GmbH, Hannover (DE)

(72) Inventors: Daniel Anetsberger, Regensburg (DE); Tet Kong Brian Chia, Regensburg (DE); Walter Sassler, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 15/129,256

(22) PCT Filed: Mar. 5, 2015

(86) PCT No.: PCT/EP2015/054658

§ 371 (c)(1),
(2) Date: Sep. 26, 2016

(87) PCT Pub. No.: WO2015/150016

PCT Pub. Date: Oct. 8, 2015

(65) Prior Publication Data

US 2017/0107931 A1 Apr. 20, 2017

(30) Foreign Application Priority Data

Apr. 3, 2014 (DE) ..... 10 2014 206 442

(51) Int. Cl.
*F02D 41/22* (2006.01)
*F02D 41/38* (2006.01)
(Continued)

(52) U.S. Cl.
CPC ..... *F02D 41/3845* (2013.01); *F02D 41/20* (2013.01); *F02D 41/222* (2013.01);
(Continued)

(58) Field of Classification Search
CPC ..... F02D 41/3845; F02D 41/222; F02D 41/3836; F02D 2041/2058; F02M 37/04; F02M 59/022; F02M 59/368; F02M 59/44
(Continued)

(56) References Cited

U.S. PATENT DOCUMENTS

2002/0033167 A1* 3/2002 Hiraku ..... F02D 41/3845 123/456
2006/0130813 A1 6/2006 Dolker
(Continued)

FOREIGN PATENT DOCUMENTS

DE 10108202 A1 8/2002
DE 10111293 A1 9/2002
(Continued)

OTHER PUBLICATIONS

International Search Report and Written Opinion dated Aug. 31, 2015 from corresponding International Patent pplication No. PCT/EP2015/054658.
(Continued)

*Primary Examiner* — Mahmoud Gimie

(57) ABSTRACT

A method and to a device for operating a pressure reservoir, where during a compression phase in a pump chamber, a pump periodically increases the pressure of a fluid located therein, and by means of a discharge valve controlled by differential pressure fluid under high pressure is allowed to be introduced from the pump chamber into the pressure reservoir. During a decompression phase following a compression phase, fluid from a fluid reservoir is introduced into the pump chamber by means of a controllable intake valve. In order to be able also to operate the pressure reservoir without a high pressure measurement directly in the pressure reservoir, the fluid pressure in the pressure reservoir is ascertained by means of a pressure determination in the
(Continued)

pump chamber. The pressure determination takes place indirectly, monitoring of the intake valve in the decompression phase.

15 Claims, 2 Drawing Sheets

(51) Int. Cl.

| | |
|---|---|
| ***F02M 59/02*** | (2006.01) |
| ***F02D 41/20*** | (2006.01) |
| ***F02M 59/36*** | (2006.01) |
| ***F02M 37/04*** | (2006.01) |
| ***F02M 59/44*** | (2006.01) |
| *F02D 41/30* | (2006.01) |

(52) U.S. Cl.
CPC ..... *F02D 41/3836* (2013.01); *F02M 37/04* (2013.01); *F02M 59/022* (2013.01); *F02M 59/368* (2013.01); *F02M 59/44* (2013.01); *F02D 2041/2055* (2013.01); *F02D 2041/2058* (2013.01); *F02D 2041/223* (2013.01); *F02D 2200/0602* (2013.01); *F02D 2200/0604* (2013.01)

(58) Field of Classification Search
USPC ..... 123/456, 447; 73/114.51
See application file for complete search history.

(56) References Cited

U.S. PATENT DOCUMENTS

| | | | | |
|---|---|---|---|---|
| 2011/0036329 | A1* | 2/2011 | Jung | F02D 41/1497 123/456 |
| 2011/0295493 | A1* | 12/2011 | Wilms | F02D 41/20 701/103 |
| 2012/0203422 | A1* | 8/2012 | Suda | F02D 41/20 701/30.4 |
| 2012/0215421 | A1 | 8/2012 | Maruyama | |
| 2014/0121943 | A1 | 5/2014 | Lee et al. | |

FOREIGN PATENT DOCUMENTS

| | | | | | |
|---|---|---|---|---|---|
| DE | 102004061474 | A1 | | 6/2006 | |
| DE | 102006033486 | A1 | * | 1/2008 | F02D 41/3845 |
| DE | 102007059116 | A1 | | 6/2009 | |
| DE | 102010064048 | A1 | | 6/2012 | |
| DE | 102011004378 | A1 | | 8/2012 | |
| DE | 102011004939 | A1 | | 9/2012 | |
| DE | 102012113141 | A1 | | 4/2014 | |
| JP | 2002138923 | A | | 5/2002 | |
| WO | 2012/089400 | A1 | | 7/2012 | |
| WO | WO 2012089400 | A1 | * | 7/2012 | F02D 41/3082 |

OTHER PUBLICATIONS

Korean Office Action and translation for corresponding Korean patent application 10-2016-7030770 dated Aug. 31, 2017.
Notice of Allowance, dated Mar. 20, 2018, for counterpart Korean application 10-2016-7030770.

* cited by examiner

METHOD AND DEVICE FOR OPERATING A PRESSURE RESERVOIR, IN PARTICULAR FOR COMMON RAIL INJECTION SYSTEMS IN AUTOMOBILE ENGINEERING

CROSS-REFERENCE TO RELATED APPLICATIONS

This application is a national phase application of PCT/EP2015/054658, filed Mar. 3, 2015, which claims priority to German Application No. 10 2014 206 442.2 filed Apr. 3, 2014. The disclosures of the above applications are incorporated herein by reference.

FIELD OF THE INVENTION

The invention relates generally to a method and device for operating a pressure reservoir, in particular for common rail injection systems in automobile engineering. The invention lies in the field of electrical engineering and mechanical engineering, and is concerned with devices and methods for operating a pressure accumulator, in particular for common-rail systems in automotive engineering. More specifically, the invention is concerned with the need for maintaining a controllable fluid pressure in a pressure accumulator of said type, in particular also when fluid intentionally or unintentionally escapes from the pressure accumulator and new fluid must be introduced at high pressure.

BACKGROUND OF THE INVENTION

Normally, in the case of high-pressure injection systems in automotive engineering, the fuel pressure in the pressure accumulator is regulated to a setpoint pressure. The regulating system commonly comprises a high-pressure sensor in the high-pressure system, which high-pressure system detects the actual pressure and transmits this to the regulation system. If a high-pressure sensor of said type is defective, the regulation no longer functions, resulting in an overpressure or an underpressure in the system. Owing to modern high-pressure systems with little leakage, it is possible, owing to the extensive optimization, for incorrect pressure levels to arise particularly easily in the event of failures. There is then a resulting risk in particular if no pressure-limiting valve is provided in the system. The use of pressure-limiting valves however entails investment costs, which can possibly be avoided if it is possible to replace a failing high-pressure sensor in an emergency situation.

Particularly high demands are placed on the function of the regulation system in the case of modern systems, too, in particular if corresponding pressure dissipation valves are not provided as analog valves but are actively integrated as digital pressure dissipation valves into the regulation.

Until now, to intercept the failure of a high-pressure valve, only emergency operation by way of a pilot control system is known, in the case of which a possibly occurring overpressure is dissipated by way of a system leakage by way of an analog pressure regulation valve. In this case, too, it can be attempted, without a pressure-limiting valve, to nevertheless avoid system overpressure.

In the case of pressure accumulators, in particular in the automotive sector in fuel injection systems, regulating systems are conventional in which a high-pressure pump delivers fuel into the pressure accumulator and is actuated by way of a control variable. Normally, the delivered fuel quantity is controlled by way of a metering valve in the feed line to the high-pressure pump.

Injection systems of said type are known for example from DE 101 11 293 A1 and from DE 10 2007 059 116 A1. Normally, such regulating systems are also combined with pressure dissipation valves which permit the dissipation of overpressure in the pressure accumulator, which is not possible in the supply branch of the fuel. Such a system is known for example from DE 101 08 202 A1.

SUMMARY OF THE INVENTION

In the context of pressure accumulator systems in general, against the background of the prior art, the present invention is based on the object of providing a method and a device for operating a pressure accumulator, which method and device combine high operational reliability with the least possible outlay in terms of construction and process, and make it possible for the pressure in the pressure accumulator to be kept in a target range as reliably as possible.

Accordingly, the present invention relates to a method for operating a pressure accumulator, in which method a pump periodically, during a compression phase in a pump chamber, increases the pressure of a fluid situated therein, and fluid at high pressure is admitted from the pump chamber into the pressure accumulator by way of a differential-pressure-controlled discharge valve, and in which method, during a decompression phase following a compression phase, fluid is admitted from a fluid reservoir into the pump chamber by way of a controllable intake valve. In this context, the object on which the invention is based is achieved in that the fluid pressure in the pressure accumulator is determined by way of a pressure determination in the pump chamber.

Normally, the setpoint variable that must be adhered to in the case of a pressure accumulator of said type is the setpoint pressure of the fluid in the pressure accumulator. Here, the fluid may be both a liquid and a gas. The pressure accumulator may for example be a pressure accumulator for the supply of water, or may also particularly advantageously be a pressure accumulator of a common-rail system in the context of a fuel injection system in automotive engineering.

Normally, for the regulation of the pressure in the pressure accumulator, high-pressure sensors are provided which detect the pressure directly in the pressure accumulator itself, and permit regulation to a setpoint variable. According to the present invention, however, the pressure in the pressure accumulator is determined indirectly by way of a pressure determination in the pump chamber.

The pressure in the pump chamber is normally subject to relatively large, periodic, precisely defined pressure fluctuations, because it is normally the case that the fluid to be delivered is initially introduced into the pump chamber at a low pressure level and, there, is subjected to a compression or other measures for the purposes of increasing pressure. Only when the pressure in the pump chamber has reached the setpoint pressure in the pressure accumulator is fluid admitted from the pump chamber into the pressure accumulator. Thereafter, the connection between the pump chamber and the pressure accumulator is shut off, and the pump runs through a further cycle, in which fluid is admitted at a relatively low pressure level into the pump chamber.

Normally, during the discharging of the fluid from the pump chamber into the pressure accumulator, fluid is delivered until the pressure in the pump chamber falls below the pressure in the pressure accumulator. If the valve (discharge valve) that connects the pump chamber to the pressure accumulator is thereupon closed, it is possible, from the fluid pressure that remains in the pump chamber, to infer the pressure prevailing at that time in the pressure accumulator.

If, subsequently, thermodynamically replicable measures are implemented in the pump chamber, for example a decompression by reversal of a pump piston, it is also possible, from a lowered pressure in the pump chamber, to later also calculate the maximum pressure, if the corresponding measures, for example the distance covered by the pump piston and thus the volume expansion in the pump chamber, are known. It is thus possible, by way of a pressure measurement in the pump chamber, to infer the pressure in the fluid chamber without a functioning pressure sensor having to be provided directly in the pressure accumulator. This may be used for example if a pressure sensor is not provided in the pressure accumulator at all, or if a pressure sensor in the pressure accumulator has failed or is to be tested.

In this regard, an advantageous refinement of the invention may provide that the pressure in the pump chamber is measured at a time between the closure of the discharge valve and the subsequent admission of fluid into the pump chamber. Thus, from the changed pressure level in the pump chamber after the discharge of the fluid into the pressure accumulator, for example as a result of a cyclic decompression phase in the case of a piston pump, the pressure in the pump chamber is determined, and the pressure at the time of the closure of the discharge valve is calculated.

A further advantageous refinement of the invention provides that the pressure in the pump chamber is determined at the time of the opening of the intake valve, in particular by way of the determination of the position of the pump piston at said time.

During the opening of the intake valve, it is normally the case that the pressure difference of the pressures in the pump chamber and in the fluid reservoir outside the pump chamber has to be overcome by a valve. An intake valve of said type may for example be in the form of a differential pressure valve, which for example opens as soon as the pressure levels on both sides of the valve correspond or differ by a defined value. Such a valve may also exhibit a certain preload, for example by way of a spring which is preloaded in an opening or closing direction, such that a certain pressure difference between the two chambers must exist in order for the intake valve to open. Furthermore, it is also possible for the force that must be applied by a valve plunger in order to open the valve to be measured and taken into consideration. In each of these cases, it is however possible, if the pressure in the fluid reservoir is known, to infer the pressure in the pump chamber from this at the time of the opening of the intake valve. If, furthermore, the time of the opening of the intake valve in the operating cycle of the pump is known, it is possible from this to infer the position of a pump piston at the time of the opening of the intake valve, and thus a compression ratio or a pressure change since the time of maximum compression/closure of the discharge valve. In this way, it is possible to infer the maximum pressure attained in the pump chamber at the start of the decompression process, said pressure normally corresponding to the pressure in the pressure accumulator, because, in the range of the maximum pressure in the pump chamber, said pump chamber is connected to the pressure accumulator by virtue of the corresponding discharge valve being opened.

If the intake valve is electronically actuated, it is possible, from the force to be applied in order to open the valve or, if the valve is held open when deenergized, from the time of the opening in the pump cycle, to infer the differential pressure, and thus, with knowledge of the pressure in the fluid reservoir, to infer the present pressure in the pump chamber. In this case, too, it is possible, if the time of the opening of the intake valve is known, to calculate the pressure in the pump chamber before the start of the decompression.

An advantageous refinement of the invention therefore provides that, from the time of the opening of the intake valve, in particular from the time difference between the opening time of the intake valve and the time of the maximum compression of the pump or of the closing of the discharge valve, the pressure in the pump chamber at the closing time of the discharge valve in the preceding compression phase is determined.

A further advantageous refinement of the invention may provide that the position of a driveable pump piston, which delimits the pump chamber, at the opening time of the intake valve is determined, in particular taking into consideration the pump speed. From the pump speed, it is possible, for example by mathematical determination or else by determination in a reference list in an evaluation device, to detect what position a pump piston of the pump is situated in at a particular time at which a pressure measurement in the pump chamber is possible, for example at the time of the opening of the intake valve. The detection of the pump speed together with the detection of the time of the pressure determination therefore permits a reliable determination of the pressure in the pump chamber in any other piston position of the pump piston, and thus also in the region of the transition from the compression phase into the decompression phase, when the pressure in the pump chamber presently falls below the pressure in the pressure accumulator.

In this respect, it is an advantageous aspect of the method according to the invention that a compression ratio is determined from the position of the pump piston at the opening time of the intake valve.

The invention may furthermore be advantageously refined such that the intake valve can be controlled electromagnetically by way of a current flowing through a magnet coil and by way of an armature that can be driven by the field of the magnet coil. The armature may for example be connected to a plunger of the intake valve, on the end of which plunger there is provided a valve closure element which can be closed against a valve opening. With a certain force which can be generated by the magnetic field of the magnet coil and which acts on the armature, it is then possible for the valve to be opened, for example. From the current that must be applied to the magnet coil in order to generate a movement of the armature, it is possible to determine the force that must be overcome in the intake valve for opening purposes. This may be generated for example by a differential pressure which acts on both sides of the valve, or by a pressing force which is exerted on the valve by a pressing spring and which holds the valve in the closed position, for example, until it is overcome by a differential pressure and/or by the force of the armature. The valve may however also be held open when deenergized, for example by way of an additional spring which acts in the opening direction.

The invention may furthermore advantageously be refined such that the current flowing through the magnet coil is monitored with regard to the current intensity.

It may also be provided that a current signal, generated in the magnet coil by an opening movement of the intake valve and of the armature, of the current flowing through the magnet coil is detected and is assigned an opening time of the intake valve. In this way, it is possible to precisely determine the time at which the armature begins to move in the field of the magnet coil, and thus the time at which the opening of the intake valve begins. At the same time, by way of the current intensity flowing through the magnet coil at said time, it is also possible to determine the total force acting on the armature, and thus, with knowledge of the construction of the valve, for example also of provided preload springs, it is also possible to determine the pressure prevailing in the pump chamber, or the differential pressure between the pressure in the pump chamber on one side of the valve and the pressure in the fluid reservoir on the other side of the valve. The time of said pressure measurement is, as described above, determined by the current signal which is generated as a result of the start of the movement of the armature and thus as a result of the sudden change in the magnetic characteristics of the system composed of magnet coil and armature. An inductive action is realized, which can be identified for example as a current maximum or bend in the current profile curve. Such a signal can be electronically discriminated, and thus the opening time of the intake valve can be precisely determined.

The inductive action of the movement of the armature may also be utilized as an indicator for the opening movement if no opening force is generated by the magnet coil and the valve is held open by a spring when deenergized. It is possible for a minimal current to be fed through the magnet coil, which generates practically no force on the armature but which permits easy identification of the induction on the current curve.

The invention relates not only to a method for operating a pressure accumulator but also to a device for generating a fluid pressure in a pressure accumulator, having a pump which has a pump chamber delimited by a driveable pump piston, wherein the pump chamber is connectable at one side to the pressure accumulator by way of a differential-pressure-controlled discharge valve and at the other side to a fluid reservoir by way of a controllable intake valve, and having an actuating device which controls the intake valve by way of an energizable magnet coil and by way of an armature that can be driven by the field of the magnet coil, and having a measurement device which detects the current flowing through the magnet coil with regard to the current intensity and which monitors for a current signal generated by a movement of the armature in the field of the magnet coil.

A device of said type, by way of the measurement device which detects the current flowing through the magnet coil with regard to the current intensity and which monitors for a current signal generated by a movement of the magnet armature, permits a precise detection of the opening time of the intake valve and thus, as described above, a determination of the pressure in the pump chamber upon the closure of the discharge valve to the pressure accumulator. It is thus possible, even without a functioning pressure sensor in the pressure accumulator, for the pressure therein to be determined and monitored with acceptable accuracy.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
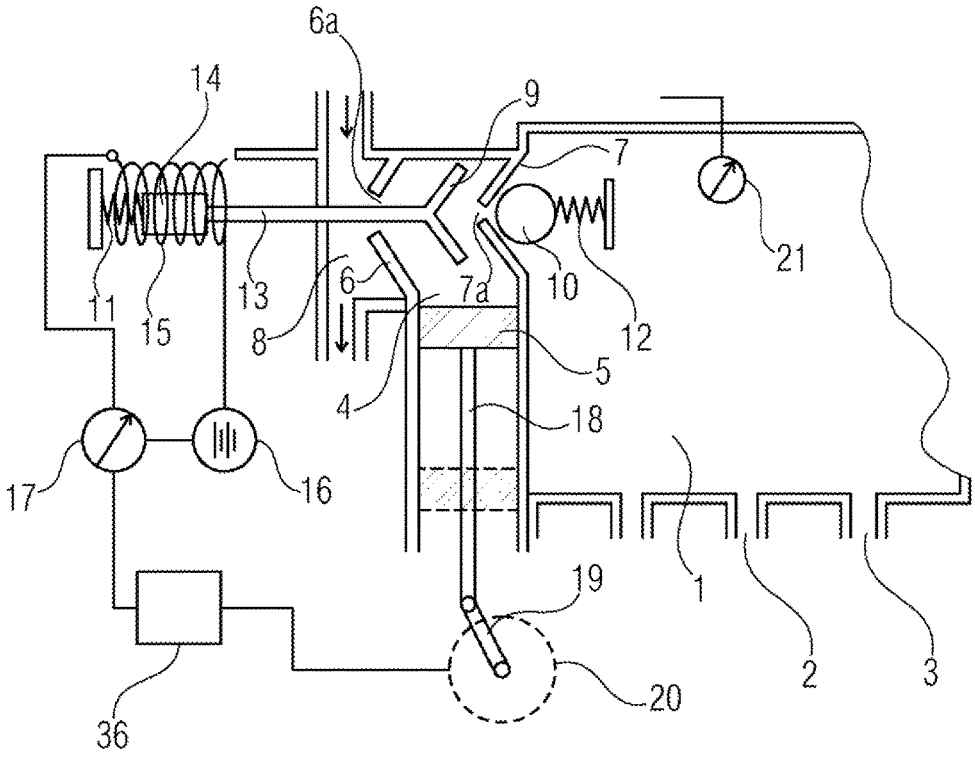
FIG. 1 schematically shows an overview of a device according to the invention for generating a fluid pressure in a pressure accumulator.

FIG. 1 schematically shows a pressure accumulator 1, which may be formed for example by a common-rail pressure accumulator in a fuel injection system of a vehicle. On the lower part of the pressure accumulator 1 there are illustrated outlets 2, 3, where injection valves are commonly arranged. For the sake of clarity, these have been omitted in the present drawing.

The device according to the invention is provided for providing fluid, in the present case that is to say a liquid in the form of fuel, in the pressure accumulator, or delivering said liquid into the pressure accumulator, at high pressure, typically several hundred bar. For this purpose, a pump chamber 4 is provided which is delimited in the fluid inlet region by a first wall 6, in the fluid outlet region by a second wall 7, and additionally by a pump piston 5.

The first wall 6 has an opening 6*a* through which fluid can flow from a fluid reservoir 8 into the pump chamber 4. The opening 6*a* can be closed by way of a first closure body 9, for example in the form of a cone, so as to form an intake valve such that no fluid can flow through the opening 6*a*. For this purpose, by way of a first compression spring 11, the first closure body 9 is pushed away from the edge of the opening 6*a* which forms a valve seat, that is to say the spring 11 acts in an opening direction of the valve. The spring 11 may, contrary to the simplified illustration in FIG. 1, act on the plunger 13 outside the pump chamber, for example in the region of the magnet coil 15.

Since the pressure in the fluid reservoir 8 is normally low, in particular lower than that in the pump chamber 4, for example is at atmospheric pressure, it is necessary, during a compression phase, for the valve 6*a*, 9, 11 which closes the first wall 6 to be actuated or activated in order to be closed. For this purpose, the valve plunger 13 is provided which can pull the closure body 9 against the opening 6*a* and against the valve seat. The valve plunger 13 is connected to a magnet armature 14, which moves in the field of the magnet coil 15 and which can be driven by virtue of the magnet coil 15 being energized. The magnet coil 15 can thus have a current applied to it such that the valve 6*a*, 9, 11 is closed. For this purpose, a force must be applied by way of the magnet coil 15 and the armature 14 which is high enough that the spring force and possibly the differential pressure between the pump chamber 4 and the fluid reservoir 8 are overcome. The plunger 13 may be separate from the closure body 9 or may in particular be connected integrally to said closure body. The spring on the closure body 9 is illustrated merely symbolically, and may be connected to the plunger outside the pump chamber, for example within the magnet coil.

The current through the magnet coil is provided by way of a current source 16 and is monitored by way of a current measurement unit 17. From the current flowing through the magnet coil 15, it is possible to determine the magnetic force acting on the plunger 13 and thus on the closure body 9.

The pump piston 5 in the pump chamber 4, or more precisely on the boundary surface of the pump chamber 4, is driven in cyclic fashion by way of a drive connecting rod 18 and a drive arm 19 of a pump motor 20. The solid lines in FIG. 1 indicate the pump piston approximately at the point of maximum compression in the pump chamber 4, that is to say in the furthest upwardly situated position in FIG. 1. From there, the pump piston 5 is, with an increase in size of the pump chamber 4, that is to say during a decompression process, pulled into the lower position shown by dashed lines, and is moved cyclically upward again from there in order to run through a further compression.

The fuel flows into the pump chamber during the entire downward movement (starting from the opening of the intake valve) of the piston. The valve 6*a*, 9, 11 is open when deenergized, and fluid can flow from the fluid reservoir 8 into the pump chamber 4. At the same time, the valve which connects the pump chamber 4 to the pressure accumulator 1, and which is formed substantially by the opening 7*a*, the second closure body 10 and the second compression spring 12, is closed. The constantly high pressure in the pressure accumulator 1 pushes the closure body 10 against the opening 7*a* in the second wall 7 and thus prevents the fluid from flowing out of the pressure accumulator 1 into the pump chamber and vice versa.

During the course of the upward movement of the pump piston 5 in the pump chamber 4, the valve 6*a*, 9, 13, 14 is closed by energization of the coil 15, and the pump chamber 4 is closed off on all sides for a period of time. The pressure can increase as far as an upper extreme position of the piston 5, wherein, at a certain time, such a high pressure is reached in the pump chamber 4 that the closure body 10 is pushed away from the opening 7*a* in the second wall 7 counter to the force of the second compression spring 12, and the pressure accumulator 1 is connected to the pump chamber 4. For this purpose, fluid can flow over from the pump chamber 4 into the pressure accumulator 1, and thus, in the case of a common-rail pressure accumulator, fuel can be replenished. When the pressure has equalized between the pump chamber 4 and the pressure accumulator 1, and when the pump piston 5 moves downward, initiating a decompression process, the closure body 10 is pushed against the opening 7*a* again, and the fluid that has been introduced into the pressure accumulator 1 remains there.

Normally, the current through the magnet coil 15 is controlled such that, as a result of the closing time of the valve 6*a*, 9, 11, 13, the fluid v, 13 that has moved from the fluid accumulator 8 through the valve into the pump chamber 4 during the suction phase assumes a precisely defined volume in the pump chamber. Following the compression, during an equalization movement of the compressed medium from the pump chamber 4 into the pressure accumulator 1, pressure equalization between the 2 chambers is achieved. In the subsequent decompression phase (pressure accumulator 1 already closed by valve 7*a*, 10, 12), the medium that has already been previously compressed must be decompressed to a lower pressure in the fluid accumulator 8 in order to permit a subsequent drawing-in of new medium. Only then will the valve 6*a*, 9, 13*b* be able to open.

To make it possible for the valve movement to be detected and evaluated during said opening process, it is normally the case that a low current is passed through the magnet coil 15, which low current is not enough to cause an actuation of the valve. Said current, and the reaction of a movement of the magnet armature on the current, can be detected by measurement, and it is thus possible for the time of the valve opening to be inferred. Depending on what pressure, reached as a result of the compression phase, has to be decompressed, an earlier or later valve opening is evident in the current profile. The time of the valve opening may be set in relation to the cyclic movement of the pump piston or of the pump motor. If the pressure in the pressure accumulator 1 falls, it is tendentially necessary for more fluid to be replenished, and, during the subsequent decompression phase, the valve 6*a*, 9, 11 opens at an earlier time than in the presence of a relatively high pressure in the pressure chamber. The time of the valve opening thus makes it possible to indirectly determine the pressure in the pressure chamber 1.

Normally, the pressure build-up and the replenishment of fluid in the pressure accumulator are subject to regulation, wherein the monitored pressure in the pressure accumulator 1 serves as a setpoint variable. Said pressure is normally monitored by way of a high-pressure sensor 21 in the pressure accumulator. If a high-pressure sensor 21 of said type fails, or if it is the intention for said high-pressure sensor to be temporarily not used, or if said high-pressure sensor is temporarily not usable, then it is possible by way of the method according to the invention for the pressure in the pressure accumulator 1 to be determined by way of an indirect measurement of the pressure in the pump chamber 4.

Figure 2:
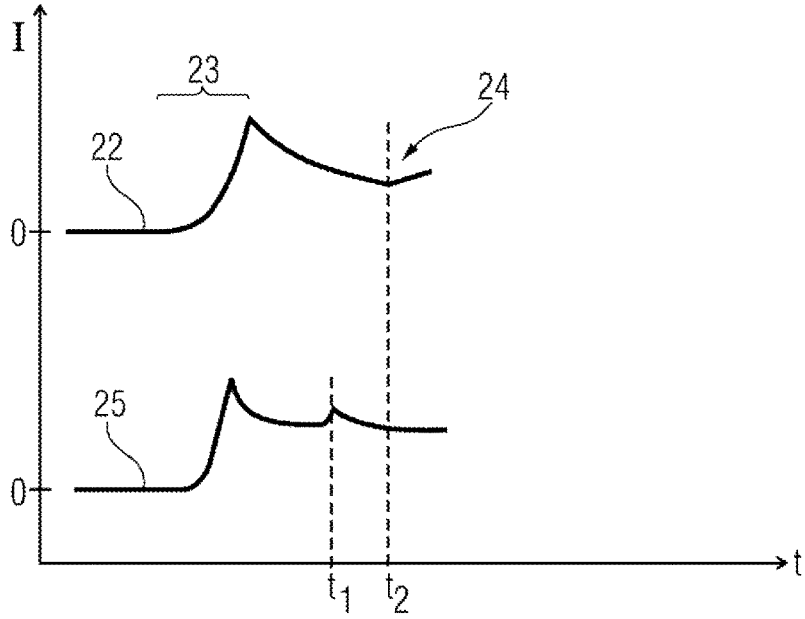
FIG. 2 shows two typical current intensity profiles of the current through the magnet coil by way of which the intake valve is controlled.

In FIG. 2, it is schematically illustrated that the current I through the magnet coil 15, measured by way of the current measurement unit 17, varies over time. In the upper curve 22, upon an actuation of the magnet coil 15, an increase of the current intensity is illustrated in the time range 23. After passing through a maximum, the current falls asymptotically owing to the induction action, wherein the magnetic field action in the coil remains constant. At the time $t_2$, the pressure in the pump chamber 4 has fallen to such an extent that the spring force acting on the plunger 13 can effect a movement of the closure body 9 counter to the differential pressure. Thus, at the time $t_2$, the plunger 13 moves, and it is thus also the case that the magnet armature 14 moves in the field of the magnet coil 15. This gives rise to an inductive reaction on the current, which is manifest in a bend 24 in the current curve, and which can thus also be verified by monitoring of the current intensity in a monitoring device 36, which is also connected to the pump motor. Through a detection of a bend point of said type, it is thus possible to identify the time $t_2$ at which the force acting on the closure body 9 in the opening direction exceeds the closure force of the valve exerted by the differential pressure.

In the lower region of FIG. 2, there is illustrated a further current curve 25 which shows a corresponding, slightly different current signal in the form of a low current maximum, on the basis of which it can be verified that, in this case, at the time $t_1$, the magnet armature 14 together with the plunger 13 has begun its opening movement.

Figure 3:
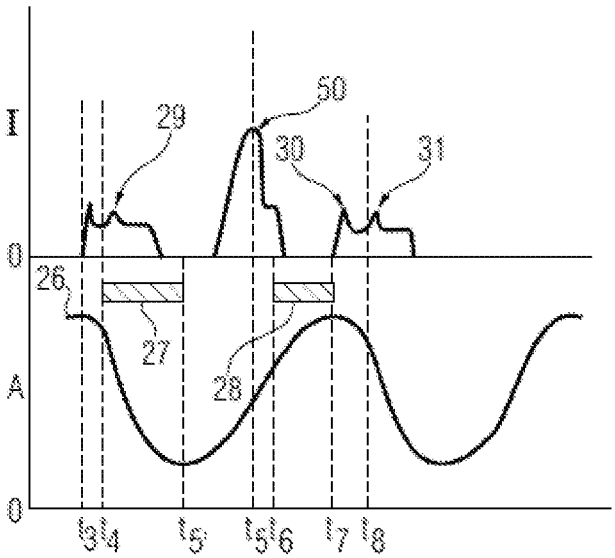
FIG. 3 shows the profile of the pump cycle, plotted versus the time, together with an illustration of the current profile in the magnet coil, which actuates the intake valve by way of an armature.

The amplitude of the movement of the pump piston 5 is illustrated schematically by the curve 26 in the lower region of FIG. 3. The upper arcs of the sinusoidal curve show the states in which the pump piston 5 moves upward during the course of a reduction in size of the pump chamber 4 in FIG. 1 and effects a compression. Thus, in the diagram, the curve 26 begins in a phase of maximum compression. At the time $t_3$, the piston 5 moves downward during the course of a decompression, and the pressure falls initially until the time $t_4$. At the time $t_4$, the piston has reached a position in which, in the illustrated example, the pressure in the pump chamber 4 has fallen to such an extent that the valve 6*a*, 9, 11 opens to the fluid reservoir 8. The intake time period of the intake valve is denoted by 27 in the diagram of FIG. 3, and extends until $t_{5'}$. In the time period 27, it is thus the case that fluid can flow over from the fluid reservoir 8 into the pump chamber 4.

After the pump piston 5 has passed through its bottom dead center and has begun an upward movement again, at the time $t_5$, the valve 6*a*, 9, 13 is closed and the pump chamber is closed on all sides, and thus the compression phase is initiated. The curve 26 rises, and the pressure in the pump chamber 4 is increased. When a maximum pressure is reached at the time $t_6$, the valve 7*a*, 10, 12 between the pump chamber 4 and the pressure accumulator 1 opens, and, over an opening time 28, fluid at high pressure can flow from the pump chamber into the pressure accumulator 1.

The upper region of the diagram of FIG. 3 illustrates a cyclic current profile which represents the current intensity through the magnet coil 15. In the region of the decompression movement of the pump piston 5 after the time $t_3$, the current through the magnet coil is increased slightly for the purposes of better detecting a valve movement. At the time $t_4$, the pressure prevailing in the fluid reservoir 8 approximately corresponds to the already-decompressed pressure in the pump chamber 4, and the valve 6*a*, 9, 13 (intake valve) subsequently opens with magnetic force assistance. This is evident from the current rise 29 that is generated as a result of induction during a movement of the magnet armature, which current rise can be used as a signal for acknowledgement of the valve opening. After the opening time 27 of the intake valve has been run through, the current through the magnet coil 15 can be shut off. At the time $t_5$, the magnetic valve has a so-called closing pulse 50 applied to it, which closes the valve 6*a*, 9, 13 (intake valve) and thus initiates the compression phase. In the diagram, the opening process is shown for a second time in the region of the curve 30, with the corresponding current signal 31, at the time $t_8$.

From the detected valve opening times $t_4$, $t_8$ in the cycle of the pump movement 26 relating to the respectively preceding TDC (top dead center) of the pump, it is possible in each case to determine the time at which the pressure in the pump chamber has been depleted again after the preceding compression phase. The pressure at the end of the compression phase can be determined by way of a previously known correlation, which is for example stored in a memory device, between valve opening time and pressure. The compression ratio in the pump chamber between the position of the pump piston reached at the time $t_4$, $t_8$ and the maximally advanced position of the pump piston, at which maximum compression is attained, is also known. It is thus possible to infer the pressure in the region of maximum compression, which, owing to the opening of the valve 7*a*, 10, 12 in said time range, corresponds precisely to the pressure in the pressure accumulator 1. This may be realized in each case by calculation of the compression ratio; it is however also possible to realize a correlation list of times $t_4$, $t_8$ at which an opening of the intake valve begins and corresponding maximum pressures in the pump chamber obtained by way of a calibration measurement.

Figure 4:
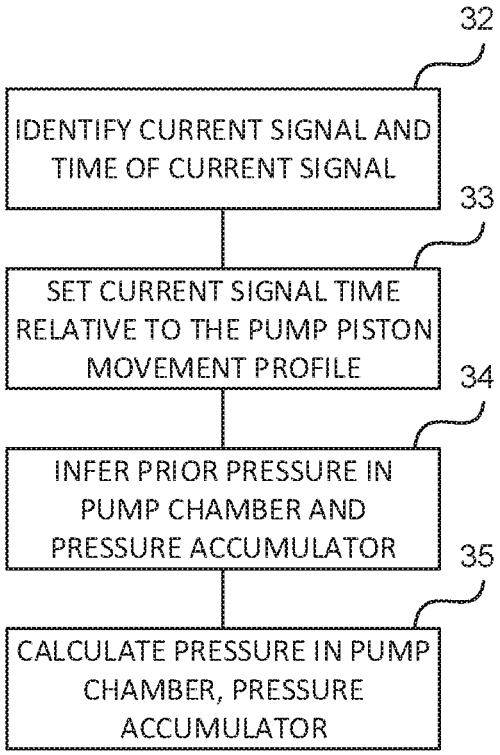
FIG. 4 shows a method flow diagram for the determination of the pressure in the pressure accumulator.

FIG. 4 schematically shows the sequence of the method according to the invention in a flow diagram, wherein a first step 32 indicates the identification of a current signal 29, 31 including the identification of the time of the current signal. In the second step 33, said time is set in relation to the profile of the pump piston movement, such that, from the known time of the current signal, it is possible to calculate the position at which the valve 6*a*, 9, 13 (intake valve) opens. From the known time of the TDC (top dead center) of the pump and that of the valve opening, determined by way of the measurable current rise (e.g. 29 and 30), it is possible to infer in the third step 34 the duration of the decompression phase, and thus the pressure that previously prevailed in the pump chamber 4 and in the pressure accumulator 1 that communicates therewith. From this, by way of the known pump parameters, in particular the distance covered by the pump piston to the maximum position, or by way of the known volume ratios in the position in which the pump piston is situated when the intake valve opens, on the one hand, and at the time of the maximum compression, on the other hand, it is possible for the ratio of the pressures at the time of the opening of the intake valve, on the one hand, and at the time of the closure of the discharge valve 7*a*, 10, 12, on the other hand, and thus the pressure in the pump chamber and in the pressure accumulator upon the closure of the discharge valve, to be calculated. This is performed in a fourth calculation step 35.

The method composed of the steps 32 to 35 may for example be performed immediately as soon as it is detected that a pressure sensor in the pressure accumulator is defective. Furthermore, the method with the steps 32 to 35 may, for the purposes of calibrating the method according to the invention, be performed in parallel with a pressure measurement by way of a high-pressure sensor in the pressure accumulator.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for operating a pressure accumulator, in which method a pump periodically, during a compression phase in a pump chamber, increases the pressure of a fluid situated therein, and fluid at high pressure is admitted from the pump chamber into the pressure accumulator by way of a differential-pressure-controlled discharge valve, and in which method, during a decompression phase following a compression phase, fluid is admitted from a fluid reservoir into the pump chamber by way of a controllable intake valve, the method comprising the steps of:

determining the fluid pressure in the pressure accumulator by way of a pressure determination in the pump chamber; and measuring the pressure in the pump chamber at a time between the closure of the discharge valve and the subsequent admission of fluid into the pump chamber.

2. The method as claimed in claim 1, wherein measuring the pressure in the pump chamber comprises the steps of determining the pressure in the pump chamber at the time of the opening of the intake valve, in particular by way of a determination of a position of a pump piston at said time of the opening of the intake valve.

3. The method as claimed in one of claims 2, further comprising the steps of determining the pressure in the pump chamber at the closing time of the discharge valve in the preceding compression phase from the time of the opening of the intake valve, in particular from the time difference between the opening time of the intake valve and the time of the maximum compression of the pump.

4. The method as claimed in claim 3, further comprising the step of determining the position of the pump piston, which delimits the pump chamber, at the opening time of the intake valve, in particular taking into consideration the pump speed.

5. The method as claimed in claim 4, further comprising the step of determining a compression ratio from the position of the pump piston at the opening time of the intake valve.

6. The method as claimed in claim 5, further comprising the step of controlling the intake valve electromagnetically by way of a current flowing through a magnet coil and by way of an armature that is driven by the field of the magnet coil.

7. The method as claimed in claim 6, further comprising the step of monitoring the current flowing through the magnet coil is with regard to the current intensity.

8. The method as claimed in claim 7, wherein monitoring the current flowing through the magnetic coil comprises detecting a current signal generated in the magnet coil by an opening movement of the intake valve and of the armature, wherein the method further comprises the step of assigning the opening time of the intake valve based on the current signal detected.

9. The method as claimed in claim 8, further comprising the step of pushing the intake valve into the open position with a defined force by way of a preload spring.

10. A device for generating a fluid pressure in a pressure accumulator, comprising:

a pump which has a pump chamber delimited by a driveable pump piston, the pump chamber being connectable at one side to the pressure accumulator by way of a differential-pressure-controlled discharge valve and at the other side to a fluid reservoir by way of a controllable intake valve;

an actuating device which controls the intake valve by way of an energizable magnet coil and by way of an armature that can be driven by the field of the magnet coil; and a measurement device which monitors the current flowing through the magnet coil with regard to the current intensity and which detects a current signal generated by a movement of the armature in the field of the magnet coil, the device assigning an opening time of the intake valve to a time of the detected current signal, determining pressure in the pump chamber at the opening time of the intake valve, and determining pressure in the pressure accumulator based upon the determined pressure in the pump chamber.

11. A method for operating a pressure accumulator, comprising:

periodically, during a compression phase in a pump chamber, increasing the pressure of a fluid situated therein;

admitting fluid at high pressure from the pump chamber into the pressure accumulator by way of a differential-pressure-controlled discharge valve;

during a decompression phase following a compression phase, providing fluid from a fluid reservoir to the pump chamber by way of a controllable intake valve; and determining pressure in the pump chamber and determining fluid pressure in the pressure accumulator based upon the determined pressure in the pump chamber, wherein the pump comprises a pump piston, and the method further comprises determining a position of the pump piston at a time of opening of the intake valve, and determining pressure in the pump chamber is based upon the determined position of the pump piston.

12. The method of claim 11, further comprising determining the pressure in the pump chamber at a time of closing of the discharge valve in a preceding compression phase from a time difference between an opening time of the intake valve and a time of a maximum compression of the pump.

13. The method of claim 11, wherein the pump piston delimits the pump chamber, and the method further comprises determining the position of the pump piston at an opening time of the intake valve, based in part upon a speed of the pump piston.

14. The method of claim 13, further comprising determining a compression ratio from the position of the pump piston at the opening time of the intake valve.

15. The method of claim 11, wherein the intake valve comprises a magnetic coil and an armature that is driven by a field of the magnetic coil, and the method further comprises controlling the intake valve using a current flowing through the magnetic coil, detecting a current generated in the magnet coil as corresponding to an opening movement of the intake valve, and assigning an opening time of the intake valve to the detected current, wherein determining pressure in the pump chamber is performed at the opening time of the intake valve.

* * * * *